US009468061B2

(12) United States Patent
Saes

(10) Patent No.: US 9,468,061 B2
(45) Date of Patent: Oct. 11, 2016

(54) LED DRIVER AND METHOD OF CONTROLLING AN LED ASSEMBLY

(75) Inventor: Marc Saes, Eindhoven (NL)

(73) Assignee: ELDOLAB HOLDING B.V., Son en Breugel (NL)

( * ) Notice: Subject to any disclaimer, the term of this patent is extended or adjusted under 35 U.S.C. 154(b) by 50 days.

(21) Appl. No.: 13/807,581

(22) PCT Filed: Jun. 28, 2011

(86) PCT No.: PCT/NL2011/050464

§ 371 (c)(1),
(2), (4) Date: Mar. 14, 2013

(87) PCT Pub. No.: WO2012/002807

PCT Pub. Date: Jan. 5, 2012

(65) Prior Publication Data

US 2013/0162165 A1 Jun. 27, 2013

Related U.S. Application Data

(60) Provisional application No. 61/359,038, filed on Jun. 28, 2010.

(30) Foreign Application Priority Data

Jun. 28, 2010 (NL) ..... 2004990

(51) Int. Cl.
*H05B 37/02* (2006.01)
*H05B 37/00* (2006.01)
*H05B 33/08* (2006.01)

(52) U.S. Cl.
CPC ..... *H05B 33/0845* (2013.01); *H05B 33/0815* (2013.01); *H05B 37/02* (2013.01)

(58) Field of Classification Search
CPC ..... H05B 37/02; G05F 3/00
USPC ..... 315/224, 294, 291, 307, 360, 209 R; 363/20; 323/371
See application file for complete search history.

(56) References Cited

U.S. PATENT DOCUMENTS 5,465,029 A * 11/1995 Hanazaki et al. ..... 315/308
7,098,608 B2 * 8/2006 Yu et al. ..... 315/291
7,256,554 B2 * 8/2007 Lys ..... 315/291

(Continued)

FOREIGN PATENT DOCUMENTS

JP 8197261 A 8/1996
WO 03032689 A1 4/2003
WO 2010061654 A1 6/2010

OTHER PUBLICATIONS

Author:Microchip, Title:PIC12F683 data sheet, Date:Dec. 8, 2006.*

*Primary Examiner* — Douglas W Owens
*Assistant Examiner* — Wei Chan
(74) *Attorney, Agent, or Firm* — Browdy and Neimark, P.L.L.C.

(57) ABSTRACT

An LED driver for powering an LED fixture is described, the LED driver including a switched mode power supply for providing a current to the LED fixture, and a control unit for controlling a switch of the switched mode power supply. The control unit includes an input terminal for receiving a set point representing a desired output characteristic of the LED fixture. The control unit is further configured to periodically determine an opening instance of the switch and a closing instance of the switch, determining an average current estimate based on at least one measurement of the current to the LED fixture at least one measurement instance determined on the basis of at least one of the opening instance or the closing instance of the switch, and applying the average current estimate as a feedback signal representing the average current for controlling the LED current.

19 Claims, 2 Drawing Sheets

(56) References Cited

U.S. PATENT DOCUMENTS

| | | | | |
|---|---|---|---|---|
| 7,276,861 | B1 | 10/2007 | Shteynberg | |
| 7,737,643 | B2 * | 6/2010 | Lys | 315/291 |
| 8,164,269 | B2 * | 4/2012 | Fukuda et al. | 315/247 |
| 8,659,239 | B2 * | 2/2014 | Liao et al. | 315/307 |
| 2006/0087298 | A1 * | 4/2006 | Turchi | 323/265 |
| 2007/0052375 | A1 * | 3/2007 | Lin et al. | 315/312 |
| 2008/0012502 | A1 * | 1/2008 | Lys | F16S 48/325 315/247 |
| 2008/0116818 | A1 * | 5/2008 | Shteynberg et al. | 315/192 |
| 2009/0195184 | A1 * | 8/2009 | Van Der Wal | H05B 33/0815 315/294 |
| 2010/0207536 | A1 * | 8/2010 | Burdalski et al. | 315/224 |
| 2011/0260643 | A1 * | 10/2011 | Huang et al. | 315/294 |
| 2013/0141002 | A1 * | 6/2013 | Esaki et al. | 315/224 |
| 2013/0154494 | A1 * | 6/2013 | Hoogzaad et al. | 315/210 |
| 2013/0162162 | A1 * | 6/2013 | May et al. | 315/224 |
| 2013/0249428 | A1 * | 9/2013 | Newman et al. | 315/224 |
| 2013/0257306 | A1 * | 10/2013 | Huang et al. | 315/210 |

* cited by examiner

LED DRIVER AND METHOD OF CONTROLLING AN LED ASSEMBLY

BACKGROUND

The present invention relates to an LED driver for powering an LED fixture comprising one or more LEDs and a method of operating an LED assembly comprising an LED driver and an LED fixture.

At present, in architectural and entertainment lighting applications more and more solid state lighting based on Light Emitting Diodes (LED) is used. LEDs or LED fixtures have several advantages over incandescent lighting, such as higher power to light conversion efficiency, faster and more precise lighting intensity and color control. In order to achieve this precise control of intensity and color from very dim to very bright light output, it is necessary to have accurate control of the current as provided to the LED fixture.

In order to provide said current to the LED fixture, an LED driver is applied. In general, an LED driver comprises a power converter or a regulator such as a linear regulator and a control unit for controlling the converter. Examples of such converters are Buck, Boost or Buck-Boost converters, fly-back converters or hysteretic converters. Such converters are also referred to as switch mode current sources. Such current sources in general provide a current comprising a ripple at a comparative high frequency (e.g. 50 kHz to 500 kHz). Depending on the type of converter that is used, said ripple (e.g. characterized by its peak to peak value) can be comparatively small or comparatively large compared to the DC value of the current. The current sources or converters as applied in an LED driver are controlled by a control unit, which can e.g. comprise a microprocessor, controller or the like. In general, the control unit receives, e.g. via a user input device, a input signal (also referred to as a set point) representing a desired output characteristic of the LED fixture. The desired output characteristic can e.g. be a desired brightness or color. As the brightness of an LED strongly depends on the current as provided to the LED, it is important to have an accurate knowledge of the current that is supplied to the LED fixture. In order for the control unit to control the power converter providing the current to the LED fixture, a feedback signal representing an average current value is often generated and provided to the control unit. Know solutions to determine such an average current value often require an extensive calculation time, resulting in an unwanted delay, or require additional hardware, resulting in an increased complexity (and thus costs) of the LED driver.

In view of these drawbacks, it is an object of the present invention to facilitate the determination of a feedback signal representing an average current as provided to an LED fixture.

SUMMARY OF THE INVENTION

According to an aspect of the invention, there is provided an LED driver for powering an LED fixture, the LED driver comprising:

- a switched mode power supply for providing a current to the LED fixture, and
- a control unit for controlling a switch of the switched mode power supply; the control unit comprising an input terminal for receiving a set point representing a desired output characteristic of the LED fixture; the control unit further being adapted to

- periodically determining an opening instant of said switch and a closing instant of said switch;
- determining an average current estimate based on at least one measurement of the current to the LED fixture at at least one measurement instant determined on the basis of at least one of the opening instant or the closing instant of the switch.
- applying the average current estimate as a feedback signal representing the average current for controlling the LED current.

The LED driver according to the invention comprises a switched mode power supply (SMPS) for powering an LED fixture. As an example of such an SMPS, Buck or Boost converters can be mentioned, as well as hysteretic converters. Such an SMPS may, in use, be supplied from a DC voltage source or a rectified AC voltage source. An SMPS as applied in the LED driver according to the invention comprises a switch enabling an amplitude of an output current of the SMPS to be controlled. In the LED driver according to the invention, the switch is controlled by a control unit which receives a set point representing a desired output characteristic of the LED fixture. Such a desired output characteristic can e.g. be a particular color or intensity. In accordance with the present invention, an LED fixture is considered to comprise one or more LEDs, which may e.g. have a different color. In general, a desired set point can be realized by applying a specific current through the LED or LEDs of the LED fixture. When a single SMPS is used to power a plurality of LEDs, the average intensity or an LED can be adjusted by operating the LED at a particular duty cycle, e.g. by periodically short-circuiting the LED.

In order to assess if a desired set point is obtained, a feedback signal representing an average current as provided by the SMPS to the LED fixture. Typically, the current as provided by an SMPS is not a constant but varies between an upper and lower boundary at a comparatively high frequency, i.e. the frequency at which the switch of the SMPS is operated. Such a current shape can also be described as a saw-tooth pattern. In known LED drivers, the average current, or an estimate of the average current is often determined by sampling the current as provided by the SMPS. Such a process (either sub-sampling or oversampling) may however require an important computational effort and may possibly require dedicated hardware requirements. Rather than determining the average current by sampling the current shape (said method e.g. requiring averaging a current value of a plurality of samples which may cause a considerable delay), the present invention determines, in an embodiment, an instant when the average current (or an estimate thereof) occurs. According to an aspect of the invention, this instant can be determined relative to either an opening instant or a closing instant of a switch of the switched mode power supply. The opening and closing instants of a switch of the switched mode power supply may e.g. be controlled by the control unit of the LED driver; as such, these instants are well known. In case the opening and closing is not controlled by the control unit but e.g. directly controlled by a comparator output (the comparator comparing a reference current signal to a signal representing the actual current value), the comparator output can be used for determining the opening and closing instants. Depending on the type of SMPS that is used, an opening of a switch of the SMPS may result in an increase or a decrease of the current that is supplied. Assuming the current to decrease when the switch is opened, the current will decrease until the switch is closed again, whereupon the current will increase again. This process will, when a stationary operation is obtained, repeat itself whereby the current will vary between an upper and lower boundary at a specific switching frequency, which can be a comparatively high frequency, e.g. ~100 kHz or more. As will be understood by the skilled person, when the current profile corresponds to a saw-tooth profile, the current will attain a value corresponding to the average current (averaged over a period spanning two consecutive openings or closings of the switch, or a multiple thereof) between an opening instant and a subsequent closing instant of the switch.

As such, in an embodiment, an average current estimate can be determined as an average of the measurement at a first measurement instant, e.g. corresponding to an opening instant of the switch and a measurement at a second measurement instant, corresponding to the closing instant of the switch. By doing so, a comparatively small computational effort is required to obtain an estimate of the average current.

In another embodiment, a single current measurement (at an instant at which whereby the maximum current occurs) may be sufficient to determine an average current estimate, the average current estimate being based on the measured maximum current, the forward voltage over the LED fixture and an off-period of the switch.

In a preferred embodiment, an average current estimate is determined substantially without requiring additional calculations based on the current measurement. In view of the above, it has been devised by the inventors that it may be preferred to determine at which instant (e.g. relative to an opening or closing instant) the actual current will correspond or substantially correspond to the average value of the current and subsequently performing a current measurement at said instant, rather than performing a plurality of current measurements and subsequently averaging the measurements in order to estimate the average current.

In an embodiment, the instant at which the average current is expected, is set at halfway between an opening and subsequent closing instant (or halfway between a closing and subsequent opening instant). In such an embodiment, it is assumed that an increase (or decrease) of the current occurs substantially in a linear manner. When the opening instants and closing instants are known, the instants halfway the opening and closing instants can be determined and used for performing a current measurement. The current value as measured is readily applicable for use as a feedback signal for the control unit. As no additional calculations need to be performed, the measured current value can be provided to the control unit of the LED driver, substantially without any delay.

In an embodiment, the current measurement is performed at an instant halfway the opening and closing instant, when the current is decreasing. When the current as provided by the SMPS is decreasing, the power supply is actually disconnected from the voltage supply powering the SMPS; in this situation, the current is supplied via a freewheeling path of the SMPS and will gradually decrease (until the switch is closed again). When the SMPS is disconnected from the voltage supply, the current variation (i.e. the descending part of the current profile) is unaffected by variations of the supply voltage of the SMPS. As such, it has been observed that a more accurate estimate of the average current is obtained when the average current is determined halfway the descending part of the current profile, compared to determining the average current halfway the ascending part of the current profile.

In an embodiment, a first current measurement is made at an instant substantially halfway between a closing instant and a subsequent opening instant and a second current measurement is made substantially halfway between an opening instant and a subsequent closing instant. Subsequently, an average current estimate is obtained by averaging the first and second current measurement. In case the period between a closing instant and a subsequent opening instant is different from the period an opening instant and a subsequent closing instant, a weighted average taking the different periods into account can be applied to obtain the average current estimate. It has been devised by the inventors that the application of one or more current measurements substantially halfway of the descending or ascending part of the current is preferred over performing a current measurement at the opening or closing instants. Because of delays of e.g. the switch or a measurement feedback, the latter measurement may be inaccurate in providing a good measurement of the maximum or minimum occurring current and may thus be inaccurate in providing an average current estimate.

In an embodiment, a calibration process is performed to determine at which instant (relative to the opening or closing instant) the average current is found. Such a calibration can take place in the factory or can be performed, on a regular basis, during normal operation. By such a calibration, a more accurate estimate of the instant at which the average current actually occurs, can be obtained.

Referring to the embodiment described above that uses the first and second current measurement substantially halfway between the switching instants, it can be noted that the first and second current measurement should, in case they would be performed when the average current occurs, be substantially identical. If this not the case, one can increase or decrease the measurement instants (e.g. in an iterative way) relative to the switching instants until the measurements substantially match. Such process may also be considered a type of calibration to arrive at the appropriate measurement instant at which the average current is likely to occur. Once such an improved measurement instant has been found e.g. by an iterative process, it may be sufficient to apply only one of the first and second current measurements as an average current measurement.

According to another aspect of the present invention, the average current estimate is applied by the control unit to determine a correction to be applied to the LED current in order to obtain or maintain the desired output characteristic. The correction in general takes one or more parameters into account which can affect the actual current as provided to the LED fixture, such parameters e.g. being the supply voltage Vsup or the forward voltage Vf over the LED assembly, or the temperature, or the di/dv slope in e.g. the steep part of the diode graph, etc. . . . . A convenient way of deriving the correction is the application of e.g. regression analysis or an other type of statistical analysis on a plurality of operating points of the LED driver under different conditions. By monitoring various parameters including the supply voltage Vsupply of the LED driver, the forward voltage Vf over an LED assembly and the average current determined and e.g. the desired current, a relationship can be derived between these parameters which can be applied as a correction (e.g. a scaling) of e.g. a current set-point (representing a desired current value) or a reference voltage of a comparator of the SMPS that e.g. controls the switching instants.

Subsequently, such a correction can be used to adjust the current supplied to the LED fixture. As will be explained in more detail below, such an adjustment of the current can be implemented in various ways, a.o. depending on the type of SMPS that is applied.

These and other aspects of the invention will be more readily appreciated as the same becomes better understood by reference to the following detailed description and considered in connection with the accompanying drawings in which like reference symbols designate like parts.

BRIEF DESCRIPTION OF THE DRAWINGS

In FIG. 1*a*, a current profile (current I vs. time t) as can be obtained from an SMPS is schematically depicted including instants ti at which the current is sampled, i.e. measured. Using this known method requires measuring the instantaneous LED current I multiple times during a period P of the current and calculate an average current from the measured values. Several disadvantages to this method can be identified:

1. the various calculations will cause a delay before the average value is available.
2. In a control unit such as a microcontroller comprising 2 comparators there is typically only 1 ADC. The measurements must then be done using alternation.
3. Many ADC conversions must be done in order to obtain the average current value. This occupancy of the ADC can block other functions implemented in the microcontroller.
4. Use of buffer memory may be required in order to store the various measurements. This memory occupancy can block other functions implemented in the microcontroller.
5. Use of processing time. This use of processing resources can block other functions implemented in the microcontroller.

Figure 1A:
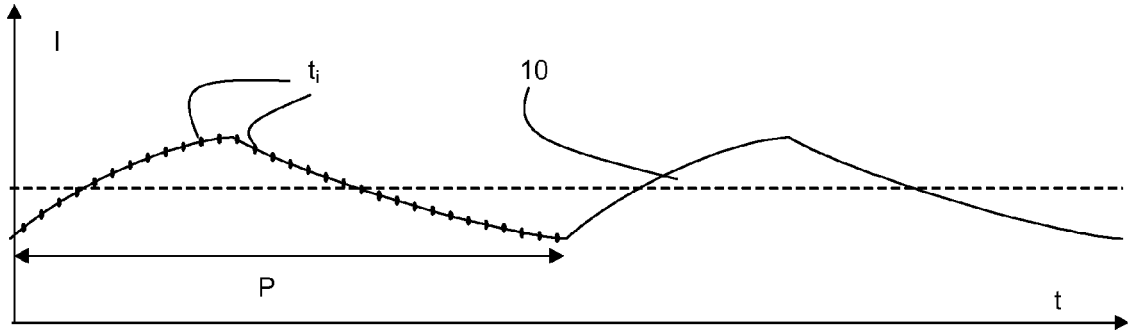
FIG. 1*a* depicts a current profile as can be obtained from an SMPS including measurement instants for determining the average current by oversampling.
Figure 1B:
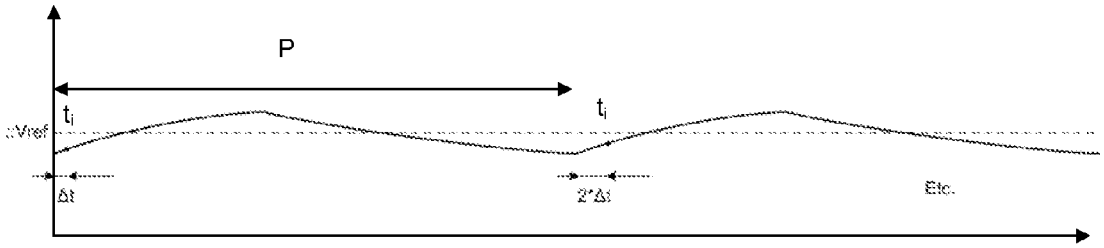
FIG. 1*b* depicts a current profile as can be obtained from an SMPS including measurement instants for determining the average current by subsampling.

Similar problems may occur when sub-sampling is applied to determine the average current. This process is schematically depicted in FIG. 1*b*.

This method comprises measuring the instantaneous LED current once during each period P (at instants ti) with an increasing offset Δt with each successive period. Subsequently, an average current is calculated from the measured values as before. The disadvantageous to this method are:

1. An even larger delay before the average value is available, especially at start-up.
2. In a control unit such as a microcontroller comprising 2 comparators there is typically only 1 ADC. The measurement must then be done using alternation.
3. Use of buffer memory. This memory occupancy can block other functions implemented in the microcontroller.
4. Slight use of processing time. This use of processing resources can block other functions implemented in the microcontroller.

In order to overcome or mitigate at least one of these drawbacks, several alternative methods of determining an average current estimate have been developed. As a first example, an average current estimate is determined as the average of the maximum current and the minimum current to the LED fixture. For such embodiment, it can be assumed that the maximum and minimum current of the saw-tooth current profile occur at the switching instants (opening and closing) of the switch of the SMPS. This provides a simple way of determining an average current estimate without a high computational cost.

Figure 2A:
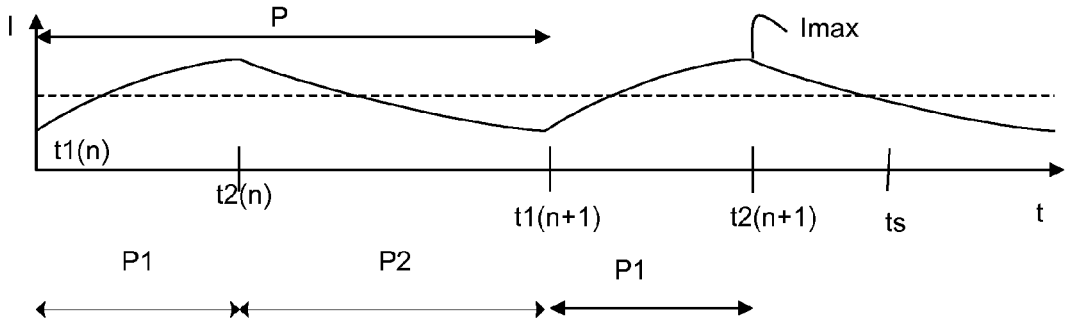
FIG. 2*a* depicts a current profile as can be obtained from an SMPS including a measurement instant for determining the average current as can be applied in an embodiment of the present invention.

In FIG. 2*a*, a way of determining the average LED current 200 according to another embodiment of the present invention is schematically depicted.

In the embodiment, it is assumed that the current I will be continuous (so the SMPS operates in continuous mode (which included boundary condition mode) as opposed to discontinuous mode).

In a first embodiment, the value of the current I is measured at the instants t1 and t2 at which the current slope reverses. Such a current slope reversal occurs when an operating state of a switch of the SMPS is changed, from an ON state to an OFF state or vice versa. The measured values at the instants t1 and t2 substantially give the maximum and the minimum value of the current (HW delays (such as the FET gate to drain-source current delay) may have to be taken into account in order to measure at slightly delayed times to obtain the real maximum and minimum. By calculating the mean of the maximum and minimum value an estimate of the average current becomes available. As the waveform is not an ideal saw-tooth, the real average current may differ slightly from the estimate. This deviation can e.g. be compensated by a calibration process.

In a further embodiment the instants t1 and t2 are recorded. After a first period P, when the first measured values for t1 and t2 are obtained, in parallel to the measurement of t1 and t2 in a next period, an estimate of the average current as provided to the LED can be obtained by estimating, based on instants t1 and t2, a measurement instant ts whereby the measured current would correspond to the average current. As such, in an embodiment of the present invention, the following can be performed each period. Based on instants t1 and t2, period P is subdivided in a period P1, corresponding to the time lapsed between t1($n$) and t2($n$) and a period P2, corresponding to the time lapsed between t2($n$) and t1($n$+1).

When denoting the period P in which the lastly measured values of t1 and t2 were obtained with sequence letter n and the next period P with sequence number n+1, then:

After P1 (measured in period n) has passed in period n+1, the microcontroller (in general, the control unit) determines a sample time or instant ts=t2($n$+1)+P2/2 where it takes a sample of the current I. Assuming a linear decay of the current between instant t2($n$+1) and instant t1($n$+1), this sample is considered as the best estimate of the average current. In this way the average current is obtained virtually instantaneously (i.e. no additional calculations are required to obtain the average current) when compared to the sub-sampling or oversampling methods.

In order to determine instant ts when the current sample is taken, the control unit can either wait for P1+P2/2 seconds starting from t1($n$+1) or wait for P2/2 seconds starting from t2($n$+1). Note that the instants t1 and t2 can, in general, easily be determined, e.g. as instants at which a comparator output changes from active to inactive (or vice versa), see e.g. FIG. 3.

Note that, as an alternative to recording instants t1 and t2, periods P1 and P2, corresponding to the time lapsed between t1($n$) and t2($n$) and t2($n$) and t1($n$+1) resp. can be equally applied. In an alternative embodiment, the sample current can be taken halfway the rising edge (i.e. halfway between t1($n$+1) and t2($n$+1). However in practice the falling edge is preferred as it is independent of the Vsup value (see further on with respect to FIG. 3) as opposed to the rising edge. Also the falling edge is typically slower, causing a smaller error due to deviations in time of the sample moment.

In an alternative embodiment, a sample of the current is taken at both the rising as the falling edge. These samples can be used as any previous sample, but it is also possible to calculate the difference between the sample from the rising edge with that from the falling edge and use that to draw a conclusion and perform actions based on that conclusion. For example the difference can be used to detect the transversal from continuous mode to discontinuous mode. The following further improvements to the method as described above can be mentioned:

As can be seen from FIG. 2*a*, considering the rising or falling edges as linear can be considered an approximation. In practice, the rising and falling edges can e.g. be characterized by one or more exponential functions having a time constant Tau, see further on. In order to obtain a better match between the current measured at ts and the true average current in a static situation, a calibration can be done resulting in an adjustment of instant ts; i.e. ts can be made higher or lower. This can be a factory calibration, a field calibration or a built in self-calibration when other means are provided to measure or determine the true average current. For example a slower method of measuring the average LED current could be available via an integrating calculation, via an extra piece of hardware, or indirectly via brightness or other feedback mechanisms in the driver or in an overall lighting system equipped with such feedback (etc.).

As an alternative, the calibration method can be to learn the waveform of the current, e.g. by oversampling or subsampling the current signal, then calculate the average value from that waveform and then calculate the percentage p of P2 that must be used for obtaining the sample instant ts at which the average current occurs:

$$ts=p*P2 \text{ (starting from } t2(n+1)\text{), where } 0<=p<=1$$

Furthermore, the average current estimate obtained could be averaged itself to be more robust for spike values caused by interference and alike. In an embodiment, the calibration method using subsampling or oversampling is performed of a plurality of periods P, wherein Iavg is calculated over each period. Comparing the average values thus obtained enables to assess whether the average current provided is changing (rising or falling) or is stable. Advantages of the method as described are:

1. No extra components, nor an extra pin of the control unit are needed. This leads f.e. to lower cost of goods or higher functionality and takes less space.
2. The value of the average current is virtually instantaneous available, as are any fluctuations in it. Note that when starting up, the waveform will be different for a certain start-up time. This needs to be taken into account, either by not using the average current estimate in calculations until it is valid for this purpose, or by adapting the way it is derived to arrive at a substantially correct estimate all the same.
3. As stated before, the delays in the control loop are an important factor in causing the final cycle frequency of the SMPS, in particular when a hysteretic converter is used, see e.g. FIG. 3. By measuring t1 and t2, the cumulative delay of several sub-delays becomes known or is taken into account. This means a lot of tolerance factors caused by the several components are compensated as well.
4. Estimates of the time constants Tau of the rising edge as well as of the falling edge could be made, helping in further characterizing the hardware instant the software is running on. This helps in further compensation of adverse effects, for example when also factors such as temperature of driver or LED engine come into play. A suitable algorithm could rely on the calculated Tau's measured at 20 Celsius when calculating corrected set-points at other temperatures. The estimates of the time constants can e.g. be applied in a model-based control strategy.

The application of the time constants can be considered a higher order determination of the average current estimate.

Figure 2B:
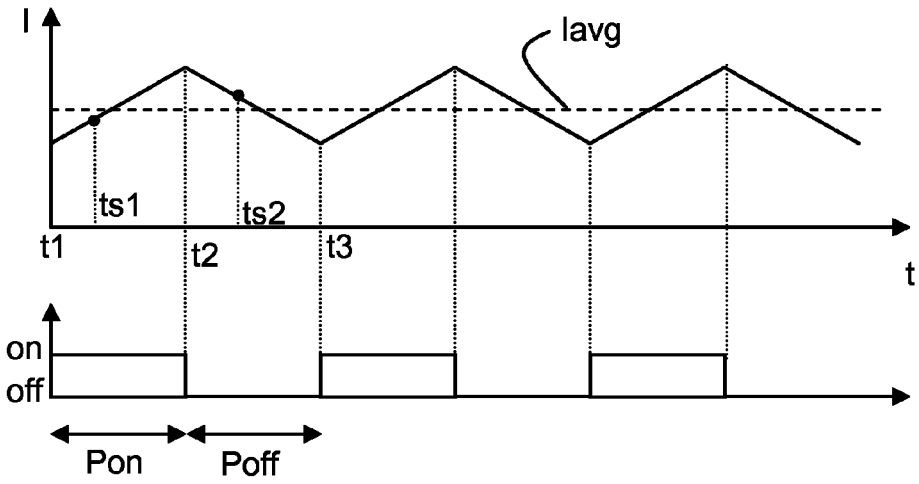
FIG. 2*b* depicts a current profile as can be obtained from an SMPS including measurement instants for determining the average current as can be applied in another embodiment of the present invention.

In FIG. 2*b*, another embodiment according to the invention is illustrated. The upper graph of FIG. 2*b* illustrates, similar to FIG. 2*a*, the saw-tooth profile of the current as generated by the LED driver and provided to e.g. an LED fixture. The lower graph shows the corresponding switching of e.g. a switch of the SMPS of the LED driver. In the embodiment, a first current measurement is made at an instant ts1 substantially halfway between a closing instant t1 (i.e. the start of period Pon) and a subsequent opening instant t2 and a second current measurement is made at an instant ts2 substantially halfway between an opening instant (e.g. opening instant t2) and a subsequent closing instant t3. Subsequently, an average current estimate is obtained by averaging the first and second current measurement. As shown, due to various delays in the LED driver behavior, the current measurements obtained at the instants ts1 and ts2 may not correspond to the average current Iavg but may be lower (in case of the measurement at ts1) or higher (in case of the measurement at ts2) than the average current Iavg. Because the delays can be considered, to a large extend, to be similar when the current is ascending or descending, it will be understood that by averaging the first and second current measurement, a more accurate representation of the Iavg can be found. In the example as shown in FIG. 2*b*, the on-time of the SMPS (Pon) is equal to the off-time (Poff)

In case the period between a closing instant and a subsequent opening instant (Pon) is different from the period an opening instant and a subsequent closing instant (Poff), a weighted average taking the different periods into account can be applied to obtain the average current estimate. In such situation, Iavg can be derived from the current measurements Its1 (current measurement at ts1) and the current measurement Its2 (current measurement at ts2) as:

$$Iavg = \frac{Pon}{Pon + Poff} Its1 + \frac{Poff}{Pon + Poff} Its2 \quad (1)$$

In the embodiment as described, the first and second current measurement should, in case they would be performed at the instants when the average current occurs, be substantially identical. If this not the case, one can increase or decrease the measurement instants ts1 and ts2 (e.g. in an iterative way) until the measurements substantially match. Such process may be considered a type of calibration to arrive at the appropriate measurement instant relative to an opening or closing instant at which the average current is likely to occur. Once such improved measurement instant has been found e.g. by an iterative process, it may be sufficient to apply only one of the first and second current measurements as an average current measurement. In yet another embodiment, applicable when the SMPS is operating in a continuous mode, the average current estimate can be obtained from a measurement of the maximum current (occurring at instants t2 in FIG. 2*a*) combined with a Toff and Vf measurement. Referring to FIG. 2*a*, a current profile is shown characterized by a peak value Imax and a period Toff (corresponding to P2). In such case, the average current can be estimated as:

$$I_{AVG} = I_{MAX} - \frac{V_f \cdot T_{off}}{2 \cdot L} \quad (2)$$

Wherein:

Imax=the maximum LED current,

Toff=the period between the opening and closing instant of the switch during which the current decreases, Vf=the forward voltage over the LED or LEDs, L=the inductance of the SMPS Once the average current or an estimate thereof is known, e.g. obtained by one of the methods as mentioned, this value can be used by the control unit in a control loop to achieve proper load and/or line regulation of the LED current. As will be understood by the skilled person, a variation of the actual current as supplied to the LED fixture will occur when parameters are changed on either the load side (represented by the LED fixture) or the line side, corresponding to the supply of the LED driver. As such, a desired set point of an output characteristic of the LED fixture (e.g. a brightness or a particular color) may vary due to variations occurring on the load or the line side. This may be undesirable. As such, according to an aspect of the invention, the control unit of an LED driver according to the invention can be arranged to determine a correction to be applied in order to control (e.g. maintain) the current to the LED fixture at a desired level. In general, the correction to be applied is a function of various parameters, a.o. the current as supplied. As such, the average current estimate Iavg can e.g. be taken into account in a function providing the correction.

In general, the correction can be represented by:

$$\text{Correction}=f(I\text{desired}, V\text{sup}, Vf, V\text{ref}, I\text{avg}) \quad (3)$$

Wherein:

Idesired=a desired current to the LED fixture,

Vsup=the supply voltage for the SMPS of the LED driver,

Vf=the forward voltage over the LED fixture,

Iavg=the average current supplied to the LED fixture,

Vref=a reference voltage as can be applied in a comparator controlling a switching of the SMPS (see further on).

The correction required to e.g. maintain a desired output characteristic can be implemented in various ways.

The correction can e.g. be implemented as an adjustment of a calculated current set point, or an adjustment of a duty cycle and/or frequency at which a switch of the SMPS is operated, or an adjustment of a reference voltage of a comparator. These ways of implementing the correction are explained in more detail below with respect to FIG. 3. In general, the desired correction can e.g. be implemented in some form in the control unit's software and thus does not require additional hardware.

A convenient way of deriving the correction is the application of e.g. regression analysis or an other type of statistical analysis on a plurality of operating points of the LED driver under different conditions. By monitoring various parameters as mentioned e.g. including the supply voltage Vsup of the LED driver, the forward voltage Vf over an LED fixture and the average current determined and e.g. the desired current, under different operating conditions, a relationship can be derived between these parameters (e.g. by regression analysis) which can be applied as a correction (e.g. a scaling) of e.g. a current set-point (representing a desired current value) or a reference voltage Vref of a comparator of the SMPS that e.g. controls the switching instants.

Using the correction function, an adjustment can be implemented resulting in a better match between the desired current Idesired and the measured current represented by Iavg, the average current estimate.

In an embodiment of the present invention, such a correction may also be determined directly, without determining or estimating the average current. It has been devised by the inventors that a required correction can e.g. be determined from the desired current, the duty cycle and frequency at which the switch of the SMPS operates. The correction can as such be determined experimentally, e.g. during a factory test, whereby the correction is provide to a memory unit of the control unit, e.g. in a tabulated form or a formula.

Figure 3:
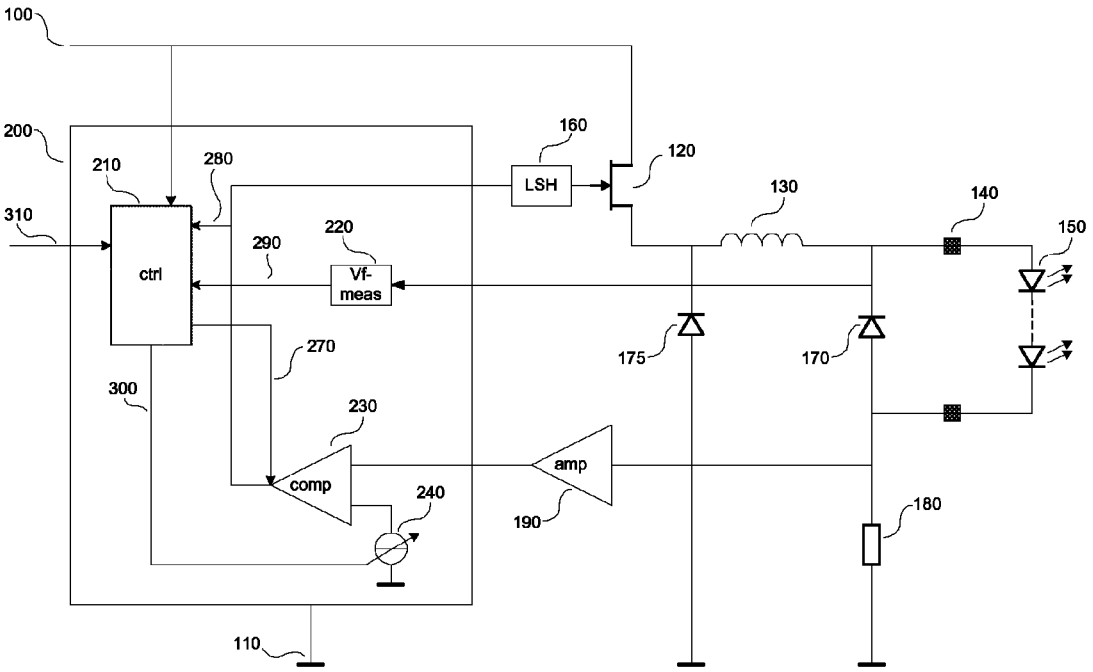
FIG. 3 schematically depicts an LED driver according to an embodiment of the present invention.

In FIG. 3, an embodiment of an LED driver according to the present invention is schematically depicted.

FIG. 3 schematically depicts and LED driver comprising a control unit 200 and an SMPS (an hysteretic converter) which is controlled by the control unit to provide a current to an array of LEDs 150. The operation of the LED driver as depicted is as follows. Switch 120 of the SMPS is operated (via a level shift circuit 160) by the control unit 200 that comprises a controller 210, a comparator 230 and a voltage measurement circuit 220. When control unit 200 operates the switch 120 via level-shifter 160, a current will flow from supply pin 100 (connected to a supply voltage Vsup) through switch 120 and coil 130 of the SMPS, LED array 150 (when connected) and a current measurement element 180 (typically a resistor). The measured voltage across 180 (representing the current through the LED array) is amplified by 190 and fed to the comparator 230. The comparator sets its output inactive when its input from the amplifier is higher than its reference voltage Vref (240) on its other input, otherwise it sets its output active. The inactive output of the comparator will open switch 120 so that the LED current is no longer flows through switch 120. The coil 130 however will decrease its magnetic field by causing a current to flow through the LED array 150, measurement element 180, fly back diode 175 back to 130. When the current is low enough, comparator 230 will reverse its output causing switch 120 to conduct again. In this way a repetitive cycle is achieved. As a result, a current profile as e.g. shown in FIGS. 1*a*-2*b* can be obtained through the LED array or LED fixture.

Without further measures, this current may vary depending on the following quantities:

- Vsupply (100-110), which can be considered a line variation,
- the forward voltage Vf across the LEDs 150, e.g. measured at terminals 140, which can be considered a load variation.

The current may also be affected by other parameters such as driver temperature, LED temperature, LED aging, circuit delays (and thus component tolerances), etc.

To illustrate the relevance, in a hysteretic converter (as e.g. shown in FIG. 3), the LED current deviations due to less than ideal load and line regulation can be as high as 20% to 30%, a.o. depending on the quality of components used.

As mentioned above, a correction can be determined which is a function of Vsup and Vf which can be applied to adjust a setting of the LED driver, in order to e.g. maintain a desired output. To this extent, Vsup and Vf (the forward voltage over the LED array 150) can be measured and provided as input signals to the control unit 200. In order to measure the LED current as e.g. described with respect to FIG. 2*a* or 2*b*, the output signal of amplifier 190 can e.g. be provided, via an ADC to the controller 210 (not shown). By applying any of the methods described above, the control unit 200 can determine an average current estimate Iavg, based on one or more current measurements, at particular instants. As such, the average current estimate Iavg as applied in eq. 2 can be obtained by the control unit 200 or controller 210.

In a first embodiment, the correction as determined on the basis of the measured value of Vsup and Vf (and optionally one or more other parameters as indicated in eq. 2) is applied to adjust a set point of the LED driver. A set point of the LED driver can e.g. denote a current set point as determined by the control unit of the LED driver based on a desired output characteristic of the LED fixture (e.g. input via a user interface) and the characteristics of the LED fixture. In the LED driver as shown in FIG. 3, input 310 can e.g. denote such a desired illumination set point (e.g. an intensity or color set point) which can be provided to an input terminal of the control unit, e.g. via a user interface (not shown). According to the first embodiment, the control unit can thus determine, based on the correction according to eq. 2, a correction-factor applicable to the set point provided as input 310 such that a variation of Vsup and/or Vf is at least partly compensated.

In a second embodiment, the required correction is implemented by the control unit as an adjustment to the reference voltage Vref of the comparator 230, said voltage determining when switch 120 changes its operating state and thus changing the current as provided by to the LED fixture.

In a third embodiment, the output of the comparator 230 is modulated by a control signal 270, thereby enabling a further way to control the current as provided to the LED fixture. As such, the current as provided to the LED fixture can be modulated with a certain frequency and duty cycle, superimposed on the current profile as e.g. shown in FIG. 2*a* or 2*b*. Modifying this modulation offers a third way to adjust the current through the LED fixture and thus a way to correct the output characteristic of the LED fixture when line or load variations occur.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language, not excluding other elements or steps). Any reference signs in the claims should not be construed as limiting the scope of the claims or the invention.

The mere fact that certain measures are recited in mutually different dependent claims does not indicate that a combination of these measures cannot be used to advantage.

The term coupled, as used herein, is defined as connected, although not necessarily directly, and not necessarily mechanically.

A single processor or other unit may fulfil the functions of several items recited in the claims.

The invention claimed is:

1. An LED driver for powering an LED fixture, the LED driver comprising:

a switched mode power supply for providing a current to the LED fixture, and a control unit for controlling a switch of the switched mode power supply, the control unit comprising an input terminal for receiving a set point representing a desired output characteristic of the LED fixture; the control unit further being configured to periodically determine an opening instant of said switch and a closing instant of said switch;

calculate at least one predetermined measurement instant having a fixed time relation to at least one of the opening instant or the closing instant of the switch;

determine an average current estimate based on measurement of the current at the calculated at least one predetermined measurement instant; and apply the average current estimate as a feedback signal representing the average current for controlling the current.

2. The LED driver according to claim 1 wherein the measurement instant is determined on the basis of an opening or closing instant of the switch at a previous switching period of the switch.

3. The LED driver according to claim 1 wherein a first measurement instant corresponds to the opening instant of the switch.

4. The LED driver according to claim 3 wherein a second measurement instant corresponds to the closing instant of the switch, the average current estimate being determined as an average of the measurement at the first measurement instant and the measurement at the second measurement instant.

5. The LED driver according to claim 1 wherein the control unit is configured to:

determine a measurement instant, relative to either the opening instant or the closing instant at which the current as provided to the LED fixture substantially equals an average current as provided during one switching period of the current and determine at the measurement instant, a signal representing the current as provided and provide the signal as a feedback signal to the control unit.

6. The LED driver according to claim 1 wherein the switched mode power supply further comprises:

an inductor, in a series connection with the switch, the switch to in a closed state thereof charge the inductor and in an open state thereof allow the inductor to discharge, a current measurement element to measure a current flowing through at least one of the inductor and the LED fixture in the Open and closed state of the switch, the switch, inductor and current measurement element being arranged to establish in operation a series connection with the LED fixture, the LED driver further comprising:

a comparator to compare a signal representing the current measured by the current measurement element with a reference, an output of the comparator being provided to a driving input of the switch liar driving the switch from one of an open and a closed state of the switch to the other one of the open and the closed state of the switch upon a change of an output state of the output of the comparator.

7. The LED driver according to claim 6 wherein the signal is provided to the control unit, via an ADC and, optionally an amplifier.

8. The LED driver according to claim 1 wherein the control unit is further arranged to receive a first input signal representing a supply voltage of the switched mode power converter and a second input signal representing a forward voltage over the LED fixture.

9. The LED driver according to claim 8 wherein the control urn is configured to determine a correction on the basis of the feedback signal and the first and second input signal.

10. The LED driver according to claim 9 wherein the control unit is configured to adjust the set point based on the correction in order to substantially maintain the desired output characteristic.

11. The LED driver according to claim 10 wherein the correction is superimposed on the set point.

12. The LED driver according to claim 6 wherein the control unit is further arranged to receive first input signal representing a supply voltage of the switched mode power converter and a second input signal representing a forward voltage over the LED fixture.

13. The LED driver according to claim 12 wherein the control unit is configured to determine a correction on the basis of the feedback signal and the first and second input signal.

14. The LED driver according to claim 13 wherein the control unit is configured to adjust the reference based on the correction in order to substantially maintain the desired output characteristic.

15. The LED driver according to claim 2 wherein a first measurement instant corresponds to the opening instant of the switch.

16. The LED driver according to claim 15 wherein a second measurement instant corresponds to the closing instant of the switch, the average current estimate being determined as an average of the measurement at the first measurement instant and the measurement at the second measurement instant.

17. The LED driver according to claim 2 wherein the control unit is arranged to:

determine a measurement instant, relative to either the opening instant or the closing instant at which the current as provided to the LED fixture substantially equals an average current as provided during, one switching period of the current and periodically determine at the measurement instant, a signal representing the current as provided and provide, the signal as a feedback signal to the control unit.

18. A method of controlling a current provided by a switch mode power converter to an LED fixture, the method comprising:

controlling a switch of the switch mode power converter by a control unit, thereby periodically determining an opening instant and a closing instant of the switch;

calculating a measurement instant, having a fixed time relation to either the opening instant or the closing instant at which the current as provided to the LED fixture substantially equals an average current as provided during is period of the current; and determining, at the measurement instant as determined, a signal representing the current as provided and provide the signal as a feedback signal to the control unit.

19. The method according to claim 18, wherein the measurement instant at which the current as provided substantially equals an average current as provided during a period of the current's determined based on the determined opening and/or closing instants.

* * * * *